US006034341A

United States Patent [19]

Horikawa et al.

[11] Patent Number: 6,034,341

[45] Date of Patent: Mar. 7, 2000

[54] CIRCUIT BREAKER

[75] Inventors: Masao Horikawa, Yamatokoriyama; Junichi Sonoda, Kawachinagano; Yoshihiro Umemoto, Kitakatsuragi-gun, all of Japan

[73] Assignee: Terasaki Denki Sangyo Kabushiki Kaisha, Osaka, Japan

[21] Appl. No.: 09/263,940

[22] Filed: Mar. 8, 1999

[30] Foreign Application Priority Data

Mar. 13, 1998 [JP] Japan ..... 10-062666

[51] Int. Cl.[7] ..... H01H 23/00

[52] U.S. Cl. ..... 200/401

[58] Field of Search ..... 200/17 R, 400, 200/401; 218/22, 30–32, 153, 154, 146; 335/6–10, 15, 16, 21

[56] References Cited

U.S. PATENT DOCUMENTS

| | | | |
|---|---|---|---|
| 3,171,938 | 3/1965 | Pokorny | 200/153 |
| 3,224,280 | 12/1965 | May et al. | 74/2 |
| 3,517,356 | 6/1970 | Hanafusa | 335/16 |
| 4,146,765 | 3/1979 | Wilson | 200/153 SC |
| 4,409,449 | 10/1983 | Takano et al. | 200/153 SC |
| 4,468,533 | 8/1984 | Kodera et al. | 200/153 SC |
| 4,616,198 | 10/1986 | Pardini | 335/16 |
| 4,645,891 | 2/1987 | Changle | 200/153 G |
| 5,571,255 | 11/1996 | Baginski et al. | 200/401 |
| 5,747,766 | 5/1998 | Waino et al. | 218/140 |

FOREIGN PATENT DOCUMENTS

| | | | |
|---|---|---|---|
| 0 062 414 | 10/1982 | European Pat. Off. | H01H 3/30 |
| 2 449 329 | 9/1980 | France | H01H 71/10 |
| 2 449 330 | 9/1980 | France | H01H 71/10 |
| 55-108119 | 8/1980 | Japan | H01H 33/40 |
| 61-39427 | 2/1986 | Japan | H01H 73/22 |

*Primary Examiner*—Michael Friedhofer
*Attorney, Agent, or Firm*—McDermott, Will & Emery

[57] ABSTRACT

In response to the movement of a moving contact which can move with small force for a large distance until it contacts a stationary contact and requires large force to move for a small distance after the contacting, three cam means including a toggle roller and a toggle cam, a coupling shaft roller and a closing cam, and a closing cam and an operation lever roller, respectively are provided to effectively distribute the closing force of a closing spring.

6 Claims, 10 Drawing Sheets

CIRCUIT BREAKER

BACKGROUND OF THE INVENTION

1. Field of the Invention

The present invention relates generally to circuit breakers and more particularly, to an opening/closing operation mechanism for a circuit breaker.

2. Description of the Background Art

A conventional circuit breaker is disclosed by Japanese Patent Laying-Open No. 61-39427 and a main part of the circuit breaker will be now described in conjunction with FIGS. 9 to 11.

A contact portion including the conduction portion of a main circuit in this circuit breaker is formed on a mold base 100, and the circuit breaker includes a stationary contact 101 also serving as a power supply side terminal, a load side terminal 102, a movable contact 103 which contacts/separates from stationary contact 101, and a flexible lead conductor 104 which connects the movable contact and the load side terminal. Movable contact 103 is pivotably supported by a movable contact holder 106 through a shaft 105. A contact pressure spring 107 is provided between movable contact 103 and movable contact holder 106 to apply contact pressure between both contacts, and movable contact holder 106 is pivotably supported by a fixed member through a shaft 108 and coupled with an insulating rod 109, which is operated by an opening/closing mechanism portion such that both contacts contact and separate as will be described.

A toggle link mechanism is employed for the opening/closing mechanism portion, and a closing link 110, a trip link 111, and a trip bar 112 in this order from an end of insulating rod 109 are coupled rotatably with one another through shafts 113, 114 and 115, respectively. Insulating rod 109 is further coupled to a connector lever 117 secured to a cross bar 116 through shaft 113, and a breaking spring 118 having one end attached to shaft 113 biases movable contact holder 106 anti-clockwise and connector lever 117 clockwise. Note that a trip mechanism coupled with trip lever 112 is not directly related to the present invention and therefore is not described.

The operation of the circuit breaker will be now described.

In this circuit breaker in a closed state as shown in FIG. 9, closing link 110 and trip link 111 are biased to bend into a dogleg shape at shaft 114, a coupling portion, by the rotational force of connector lever 117 by the force of breaking spring 118 and contact pressure spring 107, but they are held in an extended state due to engagement of one end of a closing latch 120 and a closing roller 119 provided at shaft 114.

When a tripping instruction is given in this closed state, though not detailed, trip lever 112 rotates clockwise, trip link 111 and closing link 110 move downward, connector lever 117 rotates clockwise, and movable contact holder 106 rotates anti-clockwise so that both contacts separate in a trip state as shown in FIG. 10. At this time, a closing roller 119 is detached from closing latch 120 and moves along the outer circumference of a closing cam 121 which will be described.

The circuit breaker is a spring closing type closed by operating a opening/closing mechanism by releasing a closing spring (not shown) charged by an electric motor or the like, and in a trip state, when the force of the spring is charged, closing cam 121 rotates anti-clockwise in the process, closing cam 121 is biased anti-clockwise when the charging of force completes, a holding roller 122 attached to closing cam 121 engages with a release lever 123, and a reset state as shown in FIG. 11 is attained. At this time, closing roller 119 comes into a position opposite to the edge recess portion 121*a* of closing cam 121, and trip lever 112 rotates anti-clockwise to regain the original position.

In the closing operation of this circuit breaker, as release lever 123 rotates anti-clockwise in response to a closing instruction and is disengaged from holding roller 122, and large closing force stored in the closing spring causes closing cam 121 to rapidly rotate anti-clockwise, and the outer circumference of closing cam 121 whose position comes away from the center of rotation as the rotation continues pushes closing roller 119 to the right, which causes closing link 110 and trip link 111 to be extended. This extension causes connector lever 117 to rotate anti-clockwise through shaft 113 and movable contact holder 106 to rotate clockwise such that the closed state shown in FIG. 9 is attained.

This circuit breaker must maintain insulation performance when the contacts are in an open state such as in a trip state and a reset state, and therefore stationary contact 101 and movable contact 103 are apart from each other with a relatively large insulation distance. Movable contact 103 rotates clockwise by a rotation angle corresponding to this relatively large insulation distance until contacting. During the rotation, only the closing force against breaking spring 118 is necessary. After both contacts make contact, movable contact 103 remains at the position and movable contact holder 106 further rotates slightly in the clockwise direction. The further rotation after the contacting could be described as that movable contact 103 is pressed into stationary contact 101, and the amount of the further rotation is very small in comparison to the amount of rotation since movable contact 103 starts rotating until both contacts make contact. The amount of the further rotation is necessary for securing conduction of current if the contacts wear.

Meanwhile, a spring having a large acting force is selected for contact pressure spring 107 because large contact pressure is necessary between both contacts to stably passing a rated current or resist a large short circuit current. As a result, large closing force enough to resist breaking spring 118 and contact pressure spring 107 is necessary in the rotation after the contacting.

More specifically, in the opening/closing mechanism for the circuit breaker, the rotation angle until the movable contact contacts the stationary contact is large while the closing force may be small until contact, and the rotation angle may be small while the closing force must be large enough to resist breaking spring 118 and contact pressure spring 107 in the rotation after the contacting.

Simply using a closing spring generating closing force larger than necessary for the circuit breaker is however not desirable. This is because the use of such a spring increases the size of the circuit breaker, the other elements must be also strong enough to resist the closing force, and the mechanical stress increases as a result, which is not desirable in terms of the useful life of the circuit breaker.

In this conventional circuit breaker, the cam surface of closing cam 121 is formed to have such a shape that closing link 110 and trip link 111 are greatly extended in the initial step of releasing the closing spring until both contacts come into contact and after both contacts are in contact and until the completion of closing, a large part of the closing force of the closing spring is used to slightly extend the links for the purpose of solving the above-described problem as well as satisfying the required closing characteristic.

The closing force of the conventional circuit breaker cannot be precisely controlled since the circuit breaker uses only a set of cam means (closing cam 121 and closing roller 119), and the cam means are provided at coupling shaft 114 between closing link 110 and trip link 111 through a number of elements from the contacting position of both contacts, so that a larger closing spring with larger allowance should be prepared in view of variation in the size of the parts.

Furthermore, the contact portion and the opening/closing mechanism portion must be combined for example through insulating rod 109, connector lever 117, closing link 110 and shaft 113, which makes assembling complicated.

SUMMARY OF THE INVENTION

It is therefore a main object of the present invention to provide a circuit breaker which can be manufactured compact and inexpensively and has a prolonged useful life without having to use a device to generate large closing force and elements having high strength.

Briefly stated, the circuit breaker according to the present invention includes a first contact, a second contact which contacts/separates from the first contact, a contact pressure spring which generates contact pressure between these contacts, a contact lever coupled to the second contact and rotating back and forth to allow these contacts to contact and separate, a cross bar which rotatably holds the contact lever, a breaking spring which biases the contact lever in the direction in which the second contact separates from the said first contact, a pair of link members coupled with each other and bending/extending to operate the contact lever, closing force generating means which generates closing force to extend the pair of link members, and a driving lever which rotates back and forth by the bending/extending of the pair of the link members, a roller is provided at one of the diving lever and contact lever, and a cam surface at which the roller moves is formed at the other lever.

Therefore, according to the present invention, as the contact lever portion which is close to the second contact can form the cam means, the closing characteristic can be controlled with less variation. Since the contact lever to which the contact portion is coupled and the driving lever included in the opening/closing mechanism can be coupled only by contacting with the cam means without any intervening member, if the contacting portion and the opening/closing mechanism portion are both formed into a unit, the circuit breaker can be assembled without complicated parts to couple both units.

In a circuit breaker according to another aspect of the present invention includes a first contact, a second contact which contacts/separates from the first contact, a contact pressure spring which generates contact pressure between these contacts, a contact lever coupled to the second contact and rotating back and forth to allow these contacts to contact and separate, a cross bar which rotatably holds the contact lever, a breaking spring which biases the contact lever in the direction in which the second contact separates from the said first contact, a pair of link members coupled with each other and bending/extending to operate the contact lever, and closing force generating means which generates closing force to extend the pair of link members, and the closing force causes the second contact to contact the first contact through at least two cam means.

According to a preferred embodiment of the present invention, there are first cam means including an acting cam surface formed at a closing cam rotated by closing force and a coupling shaft pushed at the acting surface to move, second cam means including an operation lever roller provided at a closing lever rotated by a closing force to rotate the closing cam and a driving cam surface formed at the closing cam pushed by the operation lever roller, and third cam means including a lever roller provided at one of a toggle lever and a contact lever coupled with one of a pair of link members and rotated by the bending/extending of the link and a lever cam surface formed at the other, and the circuit breaker includes one of the second cam means and third cam means and the first cam means.

When the first and second cam means are provided and the closing cam form two cam surfaces, closing can be controlled more precisely made with a smaller number of parts.

When the first cam means and third cam means are provided, the circuit breaker can be assembled without complicated parts and closing can be more precisely controlled.

Furthermore, by providing the first, second and third cam means, closing can be controlled more precisely with a smaller number of parts than the case of providing only two cam means.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
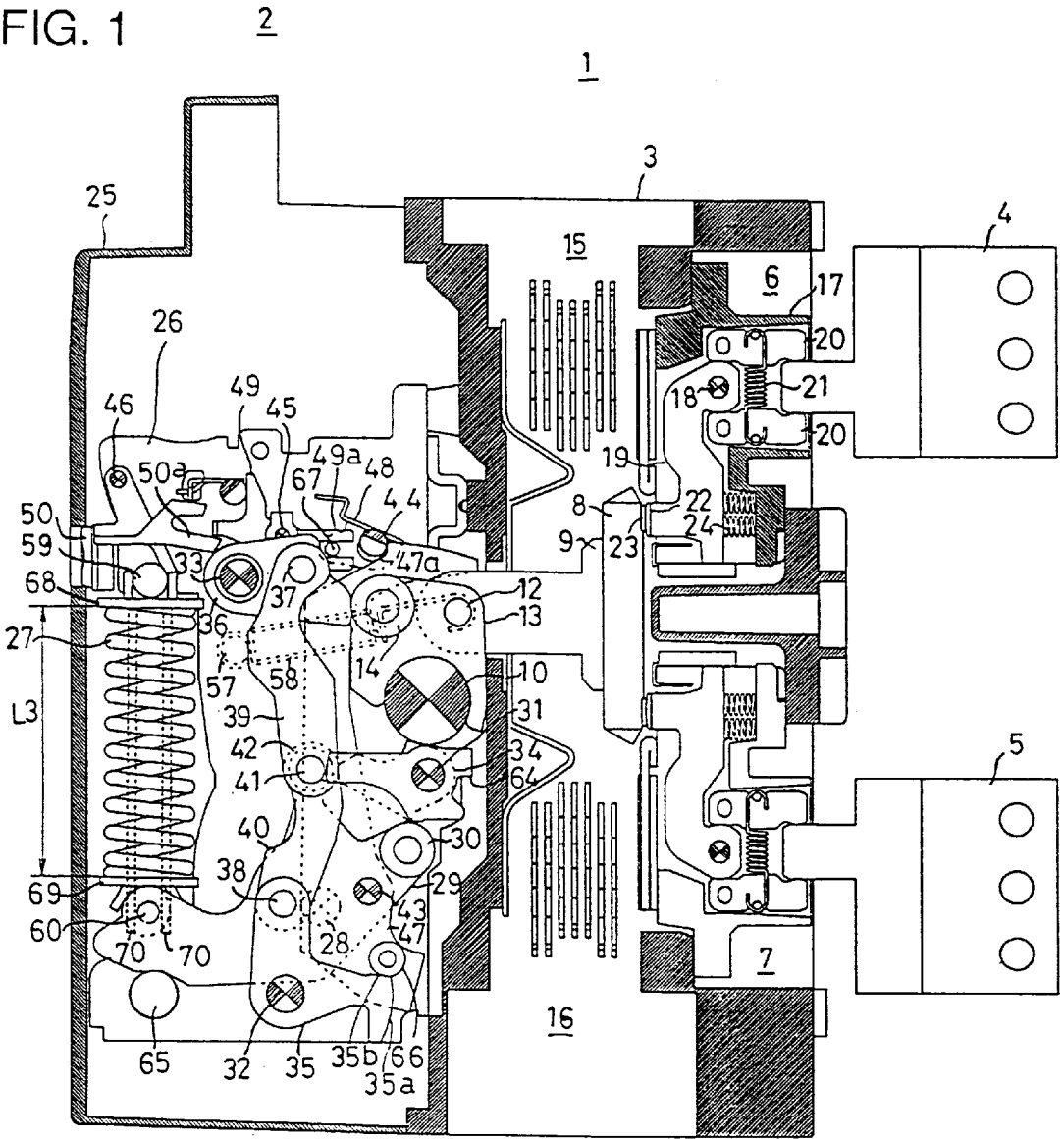
FIG. 1 is a side sectional view of a circuit breaker according to an embodiment of the present invention in a closed state.

A circuit breaker according to an embodiment of the present invention will be now described in conjunction with FIGS. 1 to 8. The circuit breaker according to the embodiment includes a contact unit 1 including opening/closing contacts and an opening/closing mechanism unit 2 which controls the opening/closing of the opening/closing contacts.

Contact unit 1 includes power supply side and load side terminals 4 and 5 provided in an insulating molding 3 and supported by means which is not shown, stationary side contact units 6 and 7 provided corresponding to the power supply and load sides, a movable contact 8 serving as a second contact which contacts and separates from both stationary side contact units 6 and 7 to disconnect and connect power supply side terminal 4 and load side terminal 5, a movable contact holder 9 of an insulating member which holds movable contact 8, guide means (not shown) which guides movable contact holder 9 to the right and left, a rotatably held cross bar 10, a contact lever 13 coupled rotatably with one end of movable contact holder 9 and rotated together with cross bar 10, a toggle roller 14 attached rotatably on contact lever 13, and arc-extinguishing devices 15 and 16 provided corresponding to the power supply and load sides, respectively to extinguish arc generated when the circuit breaker breaks current.

Stationary side contact unit 6 includes a stationary contact 19, i.e., a first contact removably attached to insulating molding 3 and rotatably provided on stationary contact mold 17 through a shaft 18, a pair of relay contacts 20 electrically connecting stationary contact 19 and power supply side terminal 4, a spring 21 which causes relay contact 20 to generate contact pressure, a contact pressure spring 24 which biases an end of stationary contact 19 attached with a stationary contact piece 22 toward the direction of a movable contact piece 23 which is attached to an end of movable contact 8. Note that stationary contact unit 7 is provided symmetrically with stationary side contact unit 6 in the horizontal direction, has the same configuration as unit 6 and therefore is not detailed. Note that stationary contact 19 slightly rotates according to this embodiment, but it may not move at all like the conventional stationary contact 101.

Opening/closing mechanism unit 2 entirely covered by a cover 25 is formed on a frame 26, and includes a closing spring 27 which generates closing force, an operation lever 29 which rotates back and forth in response to the release/charge of the force of closing spring 27 is formed at shaft 28, a closing cam 34 at a shaft 31, a trip lever 35 at a shaft 32, a toggle cam 36 at a shaft 33, a trigger lever 47 at a shaft 43, a trip actuator 48 at a trip latch shaft 44, an interlock plate 49 at a shaft 45 and a trip button 50 at a shaft 46. An operation lever roller 30 is rotatably fitted on operation lever 29. Toggle cam 36 and an upper toggle link 39 are rotatably coupled by a shaft 37, trip lever 35 and a lower toggle link 40 by a shaft 38 and an upper toggle link 29 and lower toggle link 40 by a coupling shaft 41 including a coupling shaft roller 42.

Closing spring 27 is attached between a stationary shaft 59 and a shaft 60 attached to operation lever 29 through a holding structure formed by a pair of guide ironware 70, 70 secured to an upper ironware 68 and inserted through a hole formed at a lower ironware 69.

Figure 2:
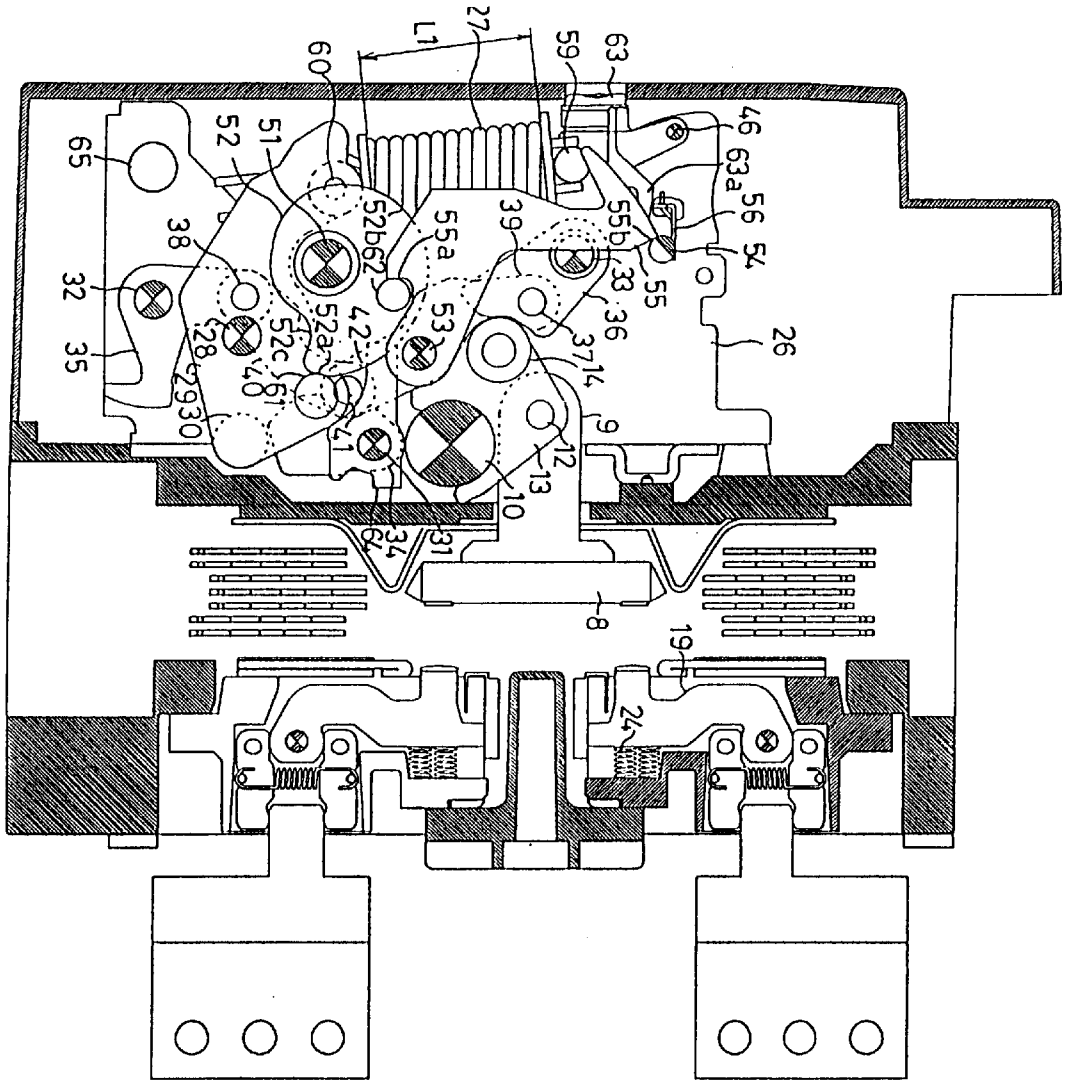
FIG. 2 is a side sectional view of the circuit breaker according to the embodiment of the present invention in a reset state.

Furthermore, as shown in FIG. 2, provided on frame 26 are a cam shaft 51 rotated by a force charging mechanism (not shown) driven by a motor or the like for closing spring, a charge cam 52 rotating together with cam shaft 51, a closing latch 55 rotatably held by shaft 53, and a closing instruction arm 56 rotating together with closing latch shaft 54.

Note that a breaking spring 58 (FIG. 1) which biases contact lever 13 to rotate anti-clockwise is provided between the contact lever shaft 12 of contact unit 1 and a secured pin 57 attached to opening/closing mechanism unit 2.

In the operation of thus formed embodiment, the operations of charging and releasing force will be now described in conjunction with FIG. 2. FIG. 2 shows a reset state in which movable contact 8 and stationary contact 19 are separated, and closing spring 27 has stored force. In FIG. 2, the closing force stored by closing spring 27 biases operation lever 29 to rotate anti-clockwise through a shaft 60. Operation lever 29 biased charge cam 52 to rotate anti-clockwise through a charge roller 61 rotatably provided on operation lever 29 and a latch cam surface 52*a* on charge cam 52 to which charge roller 61 engages. (Charge cam 52 has latch cam surface 52*a*, a force charging surface 52*b*, and a recess 52*c*.) The rotation force of charge cam 52 biases closing latch roller 62 rotatably provided on charge cam 52 to engage with closing latch 55 at an engagement portion 55*a* formed and rotate clockwise closing latch 55, the rotation force of which is received by closing latch shaft 54 at its engagement end 55*b*.

When closing spring 27 thus having stored force is released, a closing button 63 (different from trip button 50 though it has the same shape) held by a shaft 46, the same shaft as that for the previously mentioned trip button 50 is rotated anti-clockwise, a closing latch shaft 54 is rotated anti-clockwise together with a closing instruction arm 56 through an arm 63*a*. Since a cross section of closing latch shaft 54 has a semicircular notch, the rotation of closing latch shaft 54 disengages the semicircular portion and engagement end 55*b*, and closing latch 55 rotates clockwise. When this rotation disengages engagement portion 55*a* and closing latch roller 62 and charge cam 52 rotates anti-clockwise such that the recess 52*c* of charge cam 52 reaches the position of charge roller 61, operation lever 29 rotates anti-clockwise.

In order that the released closing spring 27 may charge force, a force charging mechanism rotates charge cam 52 anti-clockwise. Charge roller 61 moves on a force charging cam surface 52*b* having an outer circumference to move apart from the center of rotation as the rotation proceeds, operation lever 29 rotates clockwise following the movement, and shaft 60 moves upward to charge force. During thus charging force, charge cam 52 is driven to rotate clockwise through charge roller 61, and when the charging of force completes, charge roller 61 engages with latch cam surface 52*a* with such an angle to bias charge cam 52 anti-clockwise.

In this state, closing latch roller 62 engages with closing latch 55 at its engagement portion 55*a*, and closing instruction arm 56 and closing button 63 which have been biased anti-clockwise and clockwise, respectively, return to their original positions by the function of a regaining spring which is not shown, and the reset state as shown in FIG. 2 is regained.

The operation of closing the circuit breaker by releasing closing spring 27 will be now described in conjunction with FIGS. 1, 2, 5 and 6. In the reset states shown in FIGS. 2 and 6, closing cam 34, trip lever 35 and toggle cam 36 ae basedant-clockwise, clockwise and clockwise, respectively by a regaining spring or the like which is not shown, contact lever 13 is biased anti-clockwise by breaking spring 58, each come to rest in abutment against a stopper which is also not shown, and toggle roller 14 opposes cam surface 36*a* formed at toggle cam 36. Upper toggle link 39 and lower toggle link 40 are bent in a dogleg form, and coupling shaft roller 42 fits into recess 34*a* formed at closing cam 34 (recess 34*a*, acting cam surface 34*b* and driving cam surface 34*c* are formed at closing cam 34), and closing cam 34 opposes operation lever roller 30 at driving cam surface 34*c*.

Figure 5:
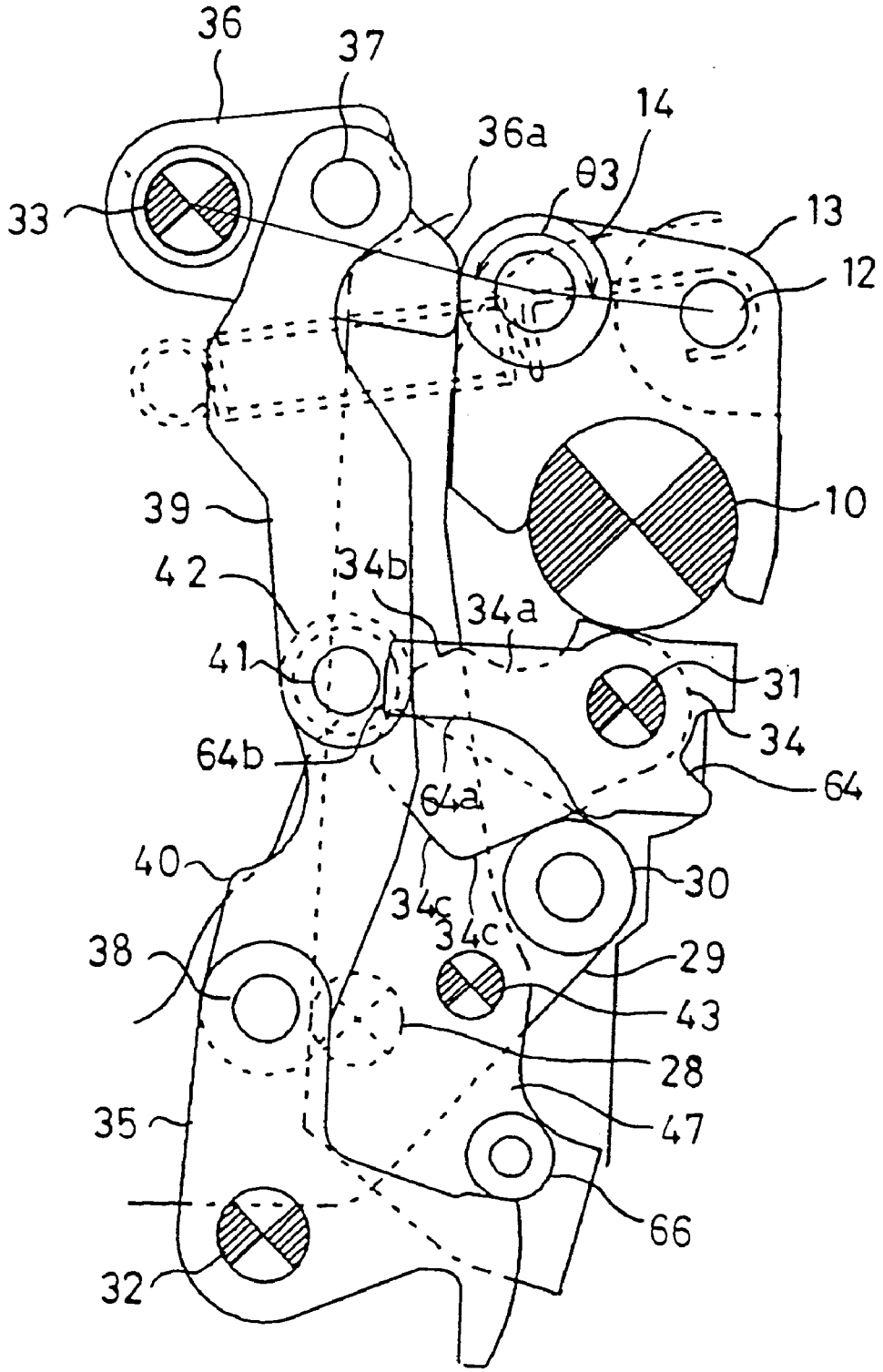
FIG. 5 is an enlarged view of a main part of FIG. 1.
Figure 6:
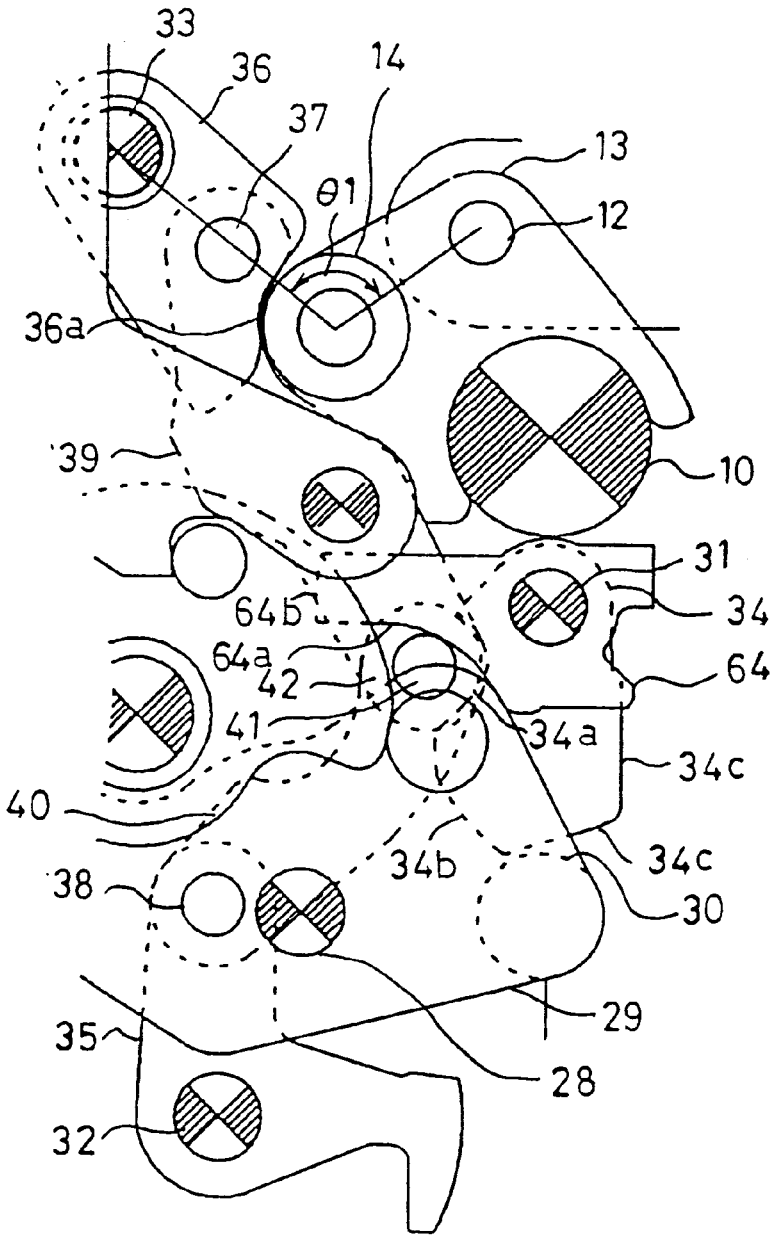
FIG. 6 is an enlarged view of a main part of FIG. 2.

When closing spring 27 is released in this state, operation lever 29 rotates anti-clockwise, operation lever roller 30 moves at driving cam surface 34*c* against the acting force of breaking spring 58 and rotates closing cam 34 as well, coupling shaft roller 42 is pushed to the left through the acting cam surface 34*b* of closing cam 34, which causes upper toggle link 39 and lower toggle link 40 to extend, and toggle cam 36 rotates anti-clockwise to move toggle roller 14 from the recess on cam surface 36*a* to the direction of the raised portion. The movement causes contact lever 13 to rotate clockwise to move movable contact 8 to the right and stationary contact 19 to rotate anti-clockwise against the acting force of contact pressure spring 24 after movable contact 8 contacts stationary contact 19, so that operation lever 29 abuts against stopper 65 to complete this closing operation and the state shown in FIGS. 1 and 5 is attained.

Note that this circuit breaker is provided with a closing retaining latch 64 coaxially with the closing cam and biased anti-clockwise by a regaining spring (not shown). During the closing operation, coupling shaft 41 rotates closing retaining latch 64 by pushing up its cam surface 64*a* and once comes apart from cam surface 64*a* when the closing operation completes. This causes retaining latch 64 to rotate anti-clockwise and return to the original positions where a retaining engagement surface 64*b* and coupling shaft 41 oppose by a stopper which is not shown. In this circuit breaker, the force of the closing spring is automatically charged by an electric motor after the closing completes, and by the charging operation, operation lever 29 rotates clockwise to rotate closing cam 34 anti-clockwise, while coupling shaft 41 engages with closing retaining latch 64 at its retaining engagement surface 64*b* instead of closing cam 34 and coupling roller 42 to maintain the extension of both toggle links.

The operation of opening the circuit breaker once closed will be now described in conjunction with FIGS. 1, 3, 5 and 7. In the closed state shown in FIGS. 1 and 5, the acting force of contact pressure spring 24 and breaking spring 58 biases trip lever 35 to rotate anti-clockwise through contact lever 13, toggle cam 36, upper toggle link 39 and lower toggle link 40. The biasing force biases trigger lever 47 to rotate anti-clockwise through trip roller 66 rotatably attached to trigger lever 47, and its engagement end 47*a* engages with trip latch shaft 44 to stop the rotation.

Figure 3:
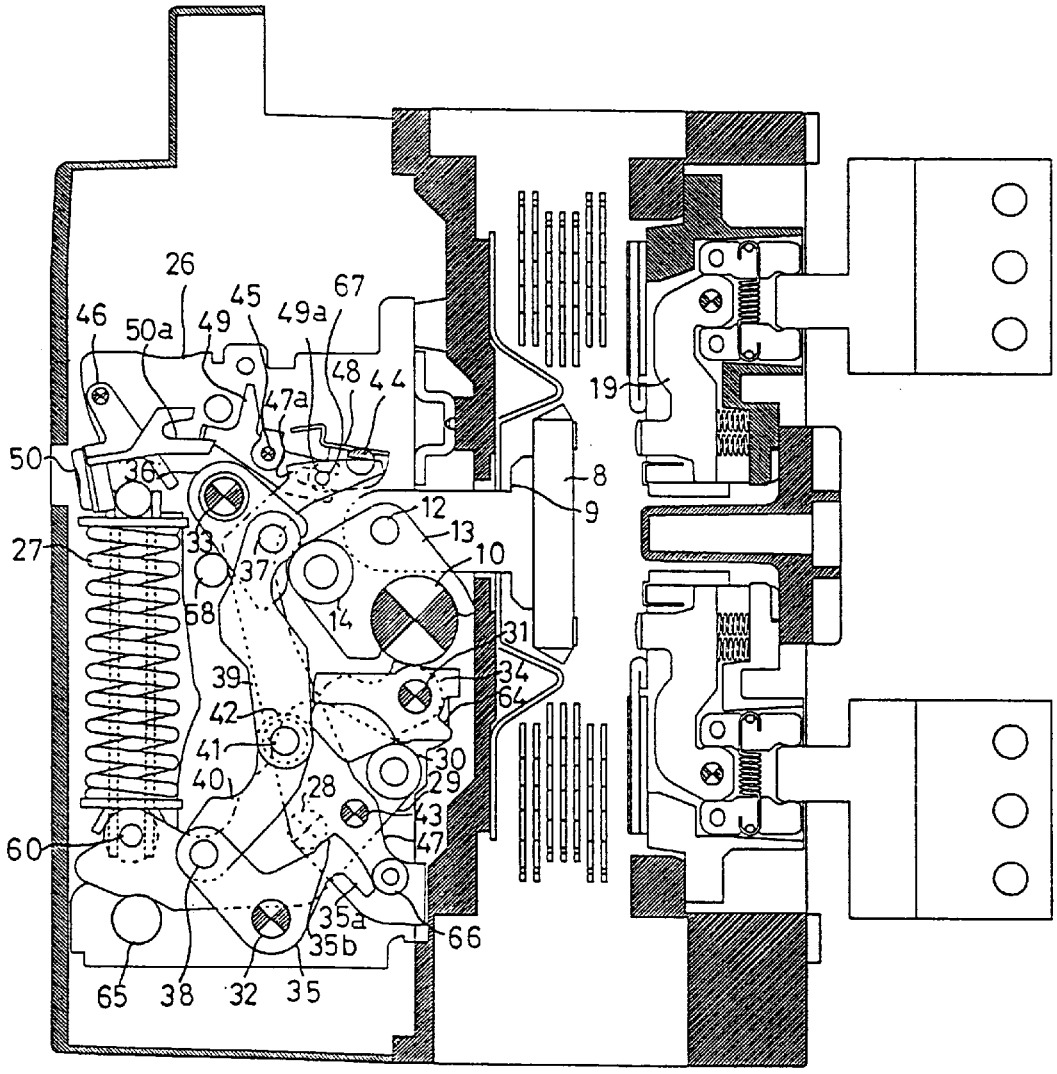
FIG. 3 is a side sectional view of the circuit breaker according to the embodiment of the present invention in a trip state.
Figure 7:
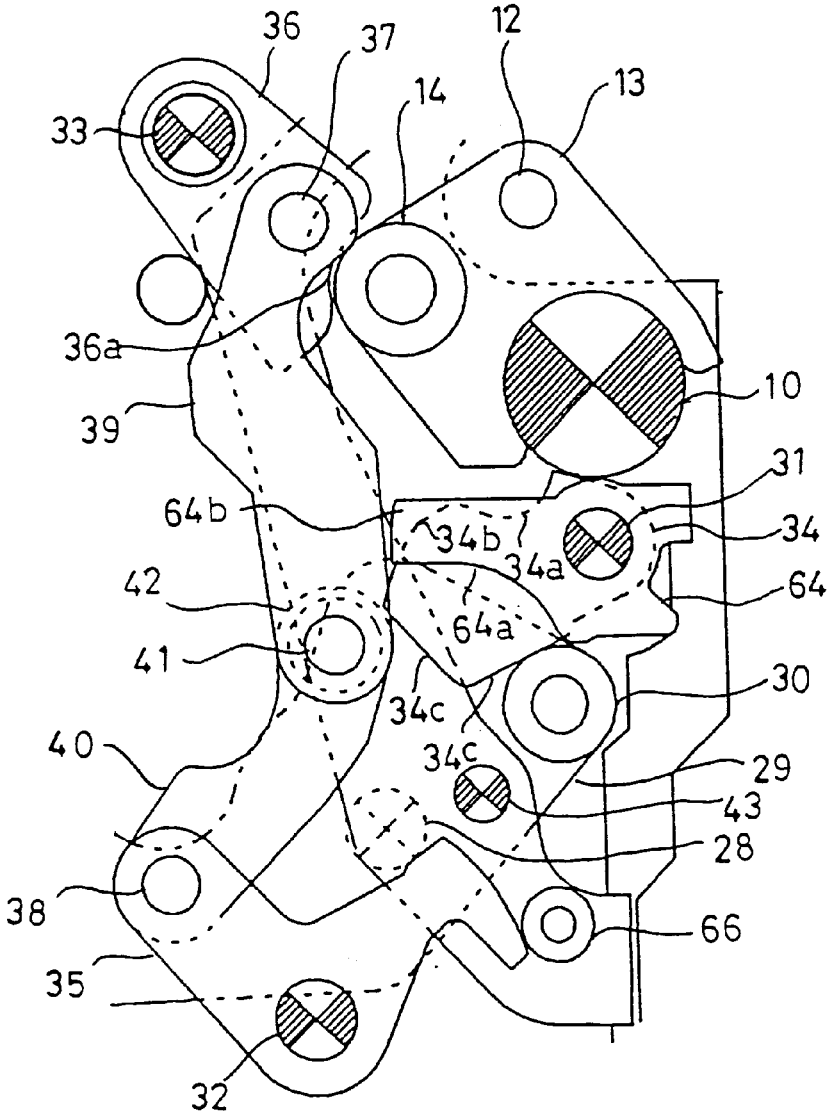
FIG. 7 is an enlarged view of a main part of FIG. 3.

To open the circuit breaker, trip button 50 is rotated anti-clockwise. This rotation causes an interlock plate 49 to rotate clockwise through arm 50a, and a trip latch shaft 44 rotates anti-clockwise together with a trip actuator 48 including a pin 67 held by crotched arm 49a. A cross section of this trip latch shaft 44 has a semicircular notch. The rotation of trip latch shaft 44 causes the semicircular portion and engagement end 47*a* to disengage and trigger lever 47 to rotate anti-clockwise, and trip lever 35 rotates anti-clockwise by disengaged from trip roller 66. This rotation causes toggle cam 36 to rotate clockwise through lower toggle link 40 and upper toggle link 39, which rotates contact lever 13 anti-clockwise as well, so that movable contact 8 moves apart from stationary contact 19. Thereafter, movable contact 8 is further moved to the left only by the function of breaking spring 58, and the trip state as shown in FIGS. 3 and 7 is attained.

The operation of resetting the circuit breaker in the trip state will be now described in conjunction with FIGS. 2, 3, 6 and 7. In this trip state, by the biasing force of trigger lever 47 biased clockwise by a regaining spring which is not shown, a trip roller 66 is in contact with trip lever 35 at its cam surface 35*a*.

After this trip state, as force is charged in closing spring 27, operation lever 29 rotates clockwise, and as operation lever roller 30 moves, closing cam 34 rotates anti-clockwise by a regaining spring. Following the rotation of closing cam 34, coupling shaft roller 42 moves to the right along the acting cam surface 34*b*, and trip lever 35 rotates clockwise by the regaining spring. When the charging of force completes, coupling shaft roller 42 reaches the position of recess 34*a* of closing cam 34. When the charging of force completes, trigger lever 47 operated by the opening operation rotates clockwise by the regaining spring, which causes trip roller 66 to come apart from cam surface 35*a* into engagement with engagement surface 35*b*, and the other parts return to the state partly shown in FIG. 1.

In the closing operation of this circuit breaker, the moving distance of movable contact 8 is large after the open state in FIG. 2 until both contacts contact similarly to the conventional circuit breaker, but there has only to be closing force to resist the acting force of breaking spring 58. The moving distance after both contacts in FIG. 4 contact until the complete closed state shown in FIG. 1 is attained is small, and there must be closing force to resist the total acting force of contact pressure spring 24 and breaking spring 58. The present embodiment has the following characteristic to satisfy these conditions.

Figure 4:
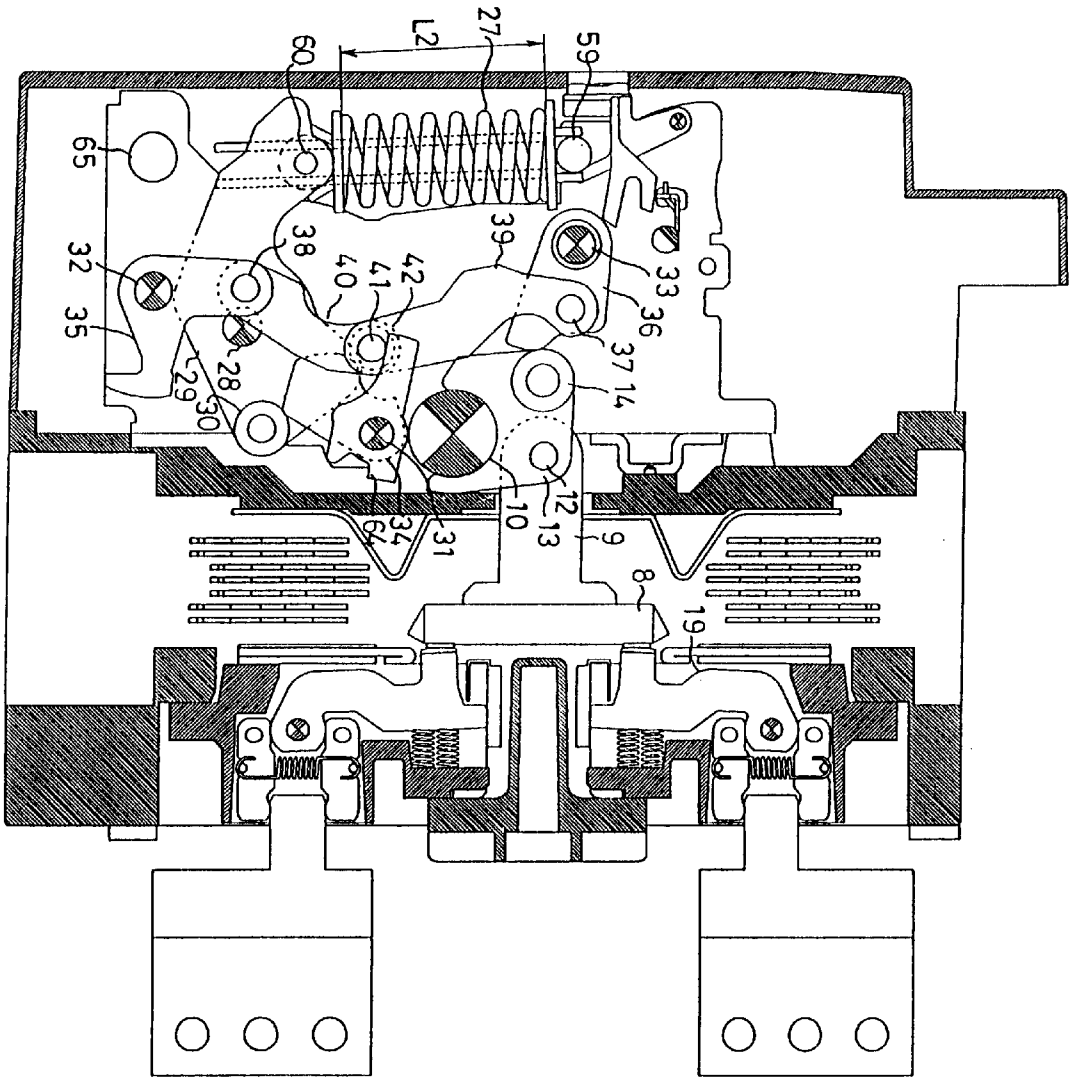
FIG. 4 is a side sectional view of the circuit breaker according to the present invention at the moment the contacts are contacted.
Figure 8:
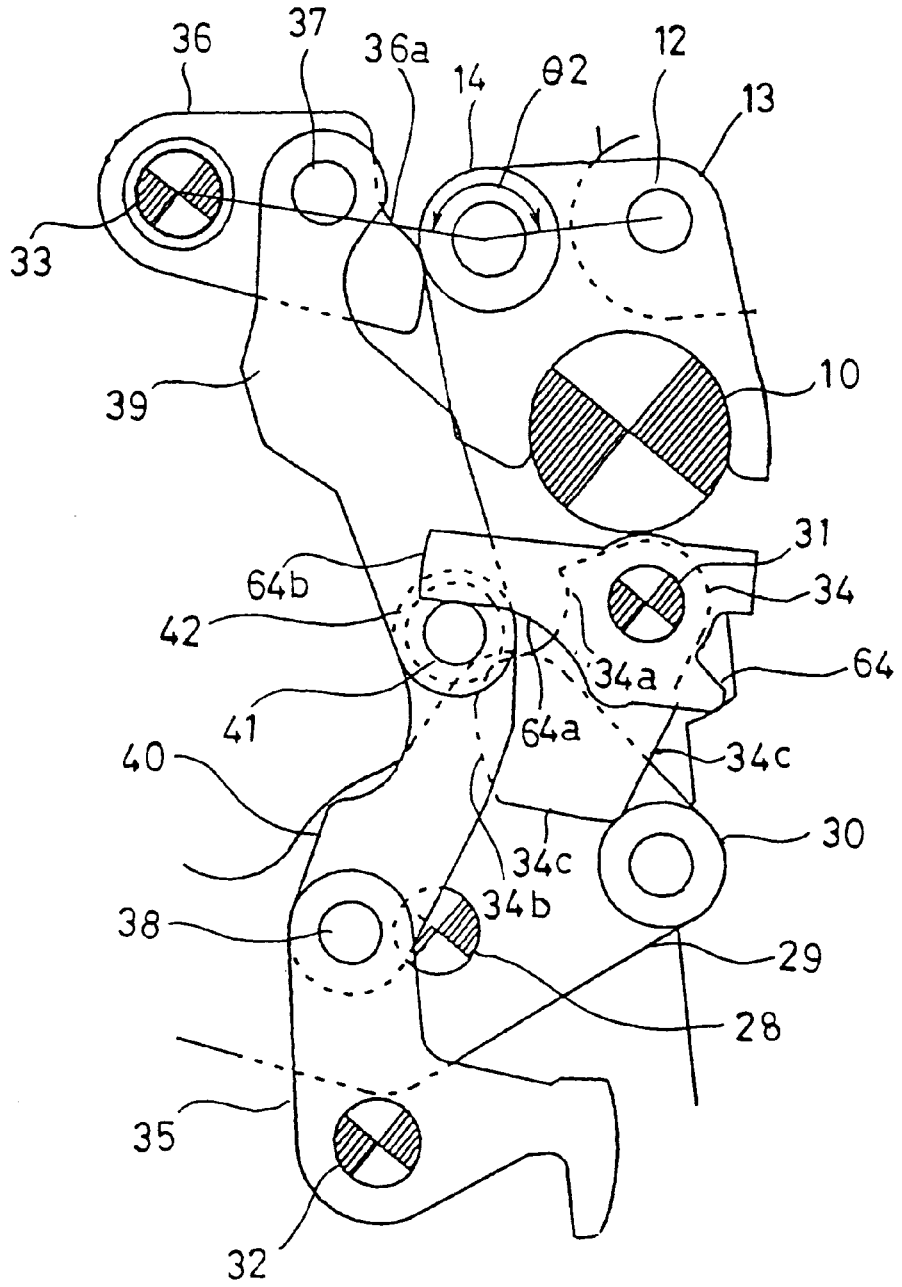
FIG. 8 is an enlarged view of a main part of FIG. 4.
Figure 9:
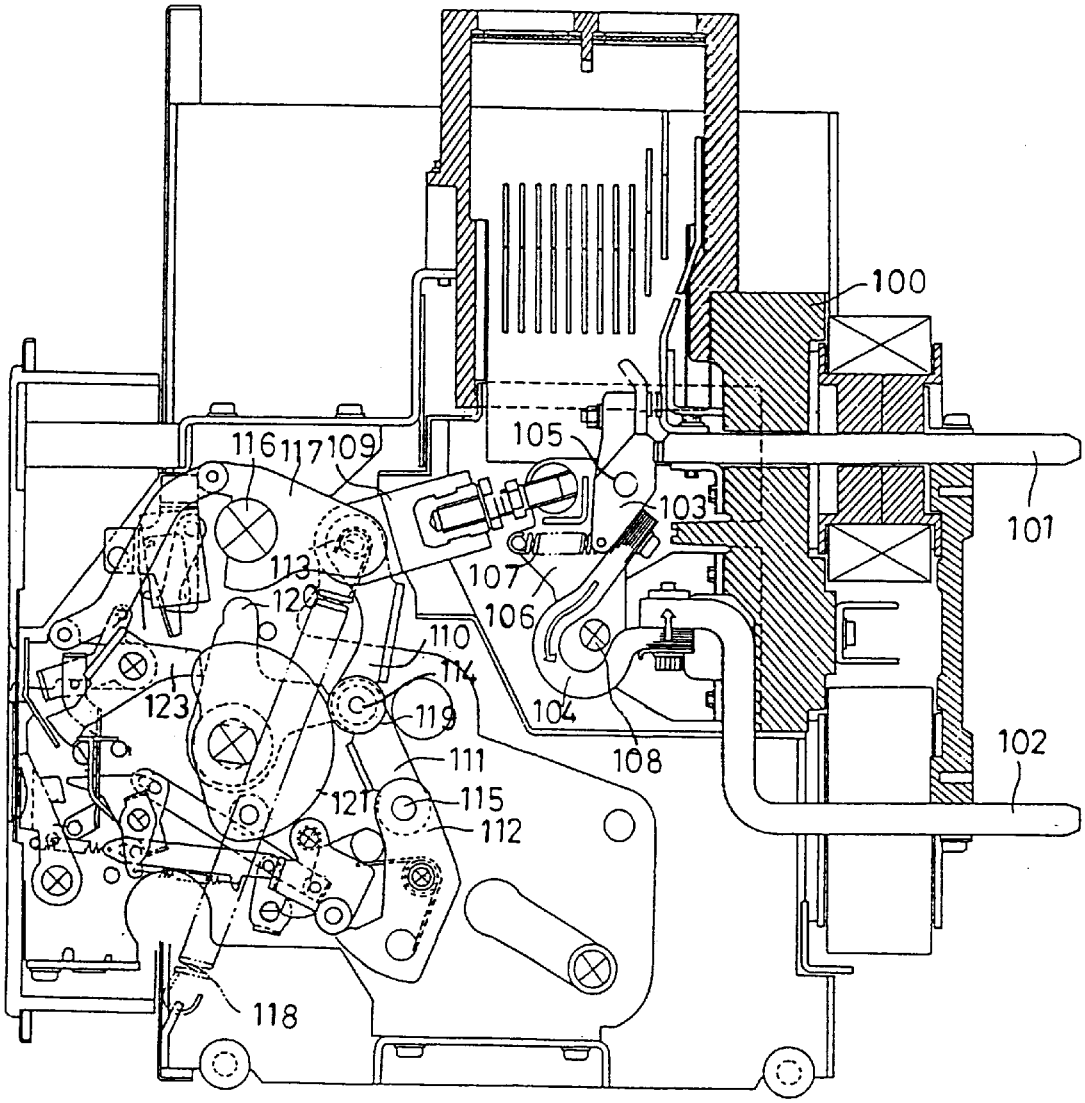
FIG. 9 PRIOR ART
FIG. 9 is a side sectional view of a conventional circuit breaker in a closed state.
Figure 10:
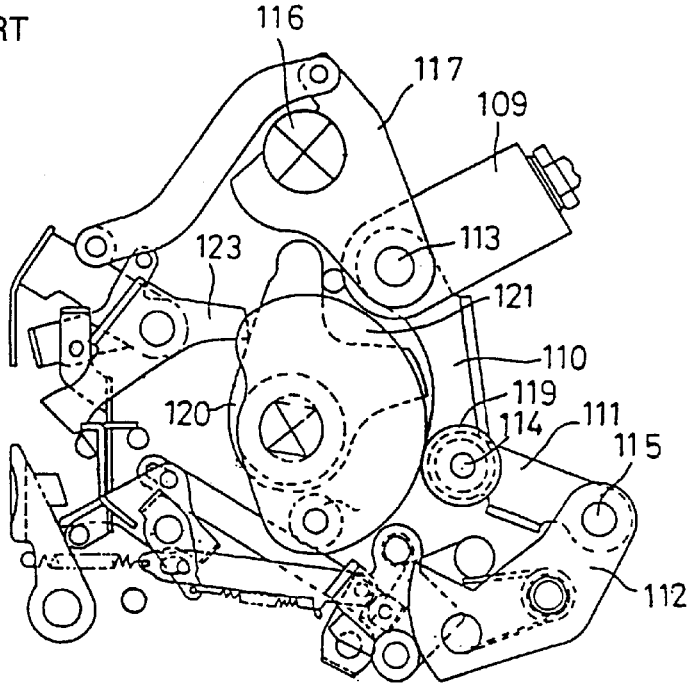
FIG. 10 PRIOR ART
FIG. 10 is a side sectional view of a main part of the conventional circuit breaker in a trip state.
Figure 11:
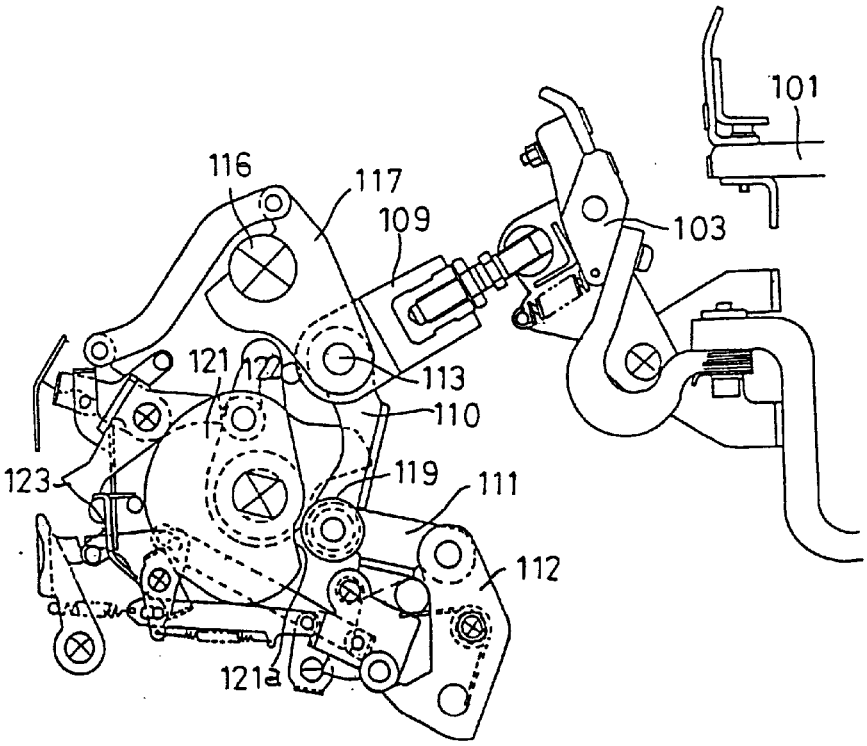
FIG. 11 PRIOR ART
FIG. 11 is a side sectional view of a main part of the conventional circuit breaker in a reset state.

FIGS. 4 and 8 show the positional relation of components at the moment both contacts in the circuit breaker according to this embodiment make contact. When the state shown in FIG. 4 is compared to the closing completed state shown in FIGS. 1 and 5, the following is found.

When the force of closing spring 27 is released, in terms of size, only regaining to the level as large as ⅓ the entirely released size (L2−L1/L3−L1), closing cam 34 has only slightly rotated relative to the entire rotation angle, a large part of the process of entire extension of upper toggle link 39 and lower toggle link 40 which have been bent in a dogleg form has completed, toggle cam 36 has completed a large part of rotation relative to the entire rotation angle, and movable contact 8 has moved for almost the entire moving distance. This state is caused because only small force to resist the acting force of breaking spring 58 is necessary until both contacts come into contact. Stated differently, the work of moving movable contact 8 for a small distance against the large acting force of contact pressure spring 24 is made by releasing the closing force of closing spring 27 about ⅔ of which in terms of size remains.

For this operation, the driving cam surface 34*c* of closing cam 34 is formed by continuous cam surfaces crossing almost at light angles, so that the engagement angle with operation lever roller 30 which operates closing cam 34 to rotate is largely different between the first and last halves of the closing operation. The acting cam surface 34*b* of closing cam 34 is formed by a short, almost horizontal cam surface starting from recess 34*a* at which coupling shaft roller 42 moves in the first half of the closing operation and a long, almost vertical cam surface at which roller 42 moves in the last half of the closing operation. In the closing operation using such a cam shape, the rotation angle of closing cam 34 per unit rotation angle of operation lever 29 is significantly larger after both contacts make contact than before, and the moving amount of coupling shaft roller 42 to the left per unit rotation angle of closing cam 34 is significantly smaller after contacting than before.

The cam surface 36*a* of toggle cam 36 is formed by a recessed cam surface, a raised cam surface and an inclined cam surface linking them such that the crossing angle between the line connecting the centers of rotation of toggle roller 14 and toggle cam 36 and the line connecting the centers of rotation of toggle roller 14 and contact lever 13 significantly changes (θ1−θ2) in the first half of the closing operation and only slightly changes in the last half (θ3−θ1). Thus, in the closing operation using the cam having such a shape, the moving amount of movable contact 8 per unit rotation angle of toggle cam 36 is significantly larger before both contacts make contact than after.

More specifically, for each of the cams, the moving amount of movable contact 8 to the right per unit releasing size of closing spring 27 is set smaller after contacting of both contacts than before, large closing force per unit moving amount of movable contact 8 can be used after contacting which requires large closing force. Thus, closing spring 27 with small capability of storing force depending upon a required closing characteristic can be formed.

Furthermore, according to this embodiment, since the cam mechanism formed by toggle roller 14 and toggle cam 36 is provided very close to movable contact 8 so that a large number of parts are not interposed between movable contact 8 and the cam mechanism, influence by variations in the size of parts is little, the process from the start of contacting of the contacts until the end of closing can be readily controlled, and therefore only small allowance for the closing force is necessary, so that closing spring 27 can be formed smaller.

Note that the main body part of the circuit breaker according to this embodiment includes contact unit 1, opening/closing mechanism unit 2 and cover 25 as previously mentioned, a part bridging these units is only breaking spring 58 which can be easily fitted and removed, and therefore the main body part can be assembled by a simple operation such as separately assembling contact unit 1 and opening/closing mechanism unit 2 and attaching opening/closing mechanism 2 to insulating molding 3 by screws (not shown), followed by attaching of breaking spring 58 and cover 25. Since breaking spring 58 needs only bias contact lever 13 anti-clockwise, one end of the spring may be attached to an arbitrary part of contact lever 13 for example, while the other end may be attached to an arbitrary part of insulating molding 3, besides the manner according to this embodiment. Then, the circuit breaker can be assembled simply by attaching opening/closing mechanism unit 2 and cover 25 to insulating molding 3.

While according to this embodiment, there are provided first cam means including acting cam surface 34*b* of closing cam 34 and coupling shaft roller 42, second cam means including driving cam surface 34*c* and operation lever roller 30, and third cam means including the cam surface 36a of toggle cam 36 and toggle roller 14, only the first and third cam means may be provided by coupling closing cam 34 and operation lever 29 by a link member while removing operation lever roller 30, or only the first and second cam means may be provided by directly coupling upper toggle link 39 to contact lever 13 while removing toggle cam 36 and toggle roller 14*a*, each of which is far more effective than providing only one cam means, although the effect is somewhat reduced from the described embodiment.

In the above embodiment, a roller is attached to a contact lever to form a cam surface at a toggle cam, it is apparent that the function/effect of the invention can be provided the opposite manner. Although the closing spring is used as the closing force generating means, the same function and effect can be provided by driving the operation lever using a solenoid.

Because the present invention is embodied as described above, and the cam means is provided very close to the second contact according to this embodiment, the movement of the second contact can be controlled with small influence by variations in the size of parts, the allowance for the closing force may be considered accordingly. Thus, since a large closing force generating device or strong parts are not necessary, the circuit breaker can be formed compact and less costly, and the mechanical stress of each part is reduced so that the useful life of the circuit breaker can be advantageously prolonged.

Furthermore, since a contact unit including contacts, a contact lever, and a roller, and an opening/closing unit including a pair of links and cams can be easily coupled, which advantageously makes assembling easy.

According to another embodiment, at least two cam means are used to effectively distribute the closing force depending upon variable load in the process of closing operation, a large device generating closing force or strong components are not necessary, the circuit breaker can be formed compact and less costly, and the stress of each part can be reduced so that the useful life of the circuit breaker can be prolonged.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circuit breaker, comprising:

a first contact;

a second contact selectively contacting and separating from said first contact;

a contact pressure spring generating contact pressure between said first and second contacts;

a contact lever coupled to said second contact and rotating back and forth to allow said first and second contacts to selectively separate and contact;

a cross bar holding said contact lever in a rotatable manner;

a breaking spring for biasing said contact lever in a direction in which said second contact separates from said first contact;

a pair of link members coupled with each other by a coupling shaft and bending and extending selectively to operate said contact lever;

closing force generating means for generating a closing force to extend said pair of link members; and a driving lever rotated back and forth by the selective bending and extending of said pair of link members, one of said driving lever and said contact lever being provided with a roller, a cam surface at which said roller moves being formed at the other.

2. A circuit breaker, comprising:

a first contact;

a second contact selectively contacting and separating from said first contact;

a contact pressure spring generating contact pressure between said first and second contacts;

a contact lever coupled to said second contact and rotating back and forth to allow said first and second contacts to selectively separate and contact;

a cross bar holding said contact lever in a rotatable manner;

a breaking spring for biasing said contact lever in a direction in which said second contact separates from said first contact;

a pair of link members coupled with each other by a coupling shaft and bending and extending selectively to operate said contact lever; and closing force generating means for generating a closing force to extend said pair of link members;

said closing force causing said second contact to contact said first contact through at least two cam means.

3. The circuit breaker as recited in claim 2, wherein said at least two cam means comprise first cam means including an acting cam surface formed at a closing cam rotated by said closing force and a coupling shaft moved by said acting cam surface.

4. The circuit breaker as recited in claim 3; wherein said at least two cam means further comprise second cam means including an operation lever roller provided at an operation lever to contact a driving cam surface of said closing cam upon rotation of the operation lever by said closing force and to rotate said closing cam.

5. The circuit breaker as recited in claim 3; wherein said at least two cam means further comprise third cam means including a lever roller and a lever cam surface, wherein said lever roller is provided at one of a toggle lever and said contact lever and said lever cam surface is provided the other one of a toggle lever and said contact lever, and wherein said toggle lever is coupled to one of said pair of link members and rotated by a selective bending and extending of said pair of link members.

6. The circuit breaker as recited in claim 5; wherein said at least two cam means further comprise second cam means including an operation lever roller provided at an operation lever to contact a driving cam surface of said closing cam upon rotation of the operation lever by said closing force and to rotate said closing cam.

* * * * *